US005911233A

United States Patent [19]

Wu

[11] Patent Number: 5,911,233

[45] Date of Patent: Jun. 15, 1999

[54] SAFETY UMBRELLA RUNNER

[76] Inventor: Tzun-Zong Wu, P. O. Box 55-846, Taipei, Taiwan

[21] Appl. No.: 09/040,373

[22] Filed: Mar. 18, 1998

[51] Int. Cl.[6] ..... A45B 25/06

[52] U.S. Cl. ..... 135/28; 135/41; 135/39

[58] Field of Search ..... 135/28, 37, 38, 135/40, 41, 39

[56] References Cited

U.S. PATENT DOCUMENTS

| | | | |
|---|---|---|---|
| 183,982 | 10/1876 | Smith | 135/40 |
| 631,442 | 8/1899 | Rose | 135/40 X |
| 1,593,494 | 7/1926 | Henry | 135/40 X |
| 3,419,026 | 12/1968 | Evans, Jr. et al. | 135/40 X |
| 3,856,032 | 12/1974 | Schafer | 135/28 |
| 5,357,994 | 10/1994 | Chung | 135/28 X |
| 5,494,064 | 2/1996 | Lee | 135/28 |
| 5,566,699 | 10/1996 | Kou | 135/28 |
| 5,588,455 | 12/1996 | Kuo | 135/28 |
| 5,615,698 | 4/1997 | Ko | 135/28 |
| 5,732,725 | 3/1998 | Ko | 135/28 |
| 5,740,824 | 4/1998 | Tang | 135/28 |

*Primary Examiner*—Carl D. Friedman
*Assistant Examiner*—Winnie S. Yip

[57] ABSTRACT

A safety umbrella runner includes: a runner tube slidably held on a central shaft of the umbrella; an inner ferrule integrally circumferentially formed on the runner tube, adapted for pivotally securing a plurality of ribs for fastening an umbrella cloth on the ribs, by a fastening wire wound on the inner ferrule and having wire ends twisted and knotted in a socket formed in the inner ferrule; and an outer ferrule snugly engaged with and disposed outside the inner ferrule for sheltering the wire ends for preventing the user or worker from being pricked by the wire ends, and having a pendent cover protruding from the outer ferrule for sheltering a spring catch resiliently protruded from the central shaft for preventing injury to the user's finger by the spring catch.

1 Claim, 7 Drawing Sheets

SAFETY UMBRELLA RUNNER

BACKGROUND OF THE INVENTION

A conventional runner R slidably held on a central shaft S of an umbrella as shown in FIG. 1 includes a steel wire W fastened on the runner for pivotally securing a plurality of ribs B of the umbrella. The ends of the twisted wire knot K may prick the umbrella user or factory worker. A spring catch C resiliently protruded from the shaft S for locking the runner R when opening the umbrella may also injure a user's finger.

U.S. Pat. No. 5,566,699 disclosed a safety runner having a U-shaped cap (3) sheltering the wire end of the steel wire secured on the runner for preventing fingers from being injured. However, a worker for assembling the cap (3) on the runner may still be pricked or injured by the wire end. The cap (3) also forms an abrupt extension unsymmetric and unharmonious to the runner ferrule, thereby affecting its esthetic ornamental function. Meanwhile, there is still no protection formed on the runner for sheltering the spring catch as resiliently held on the umbrella shaft.

The present inventor has found the drawbacks of the conventional safety runner and invented the present safety runner for umbrella.

SUMMARY OF THE INVENTION

The object of the present invention is to provide a safety umbrella runner including: a runner tube slidably held on a central shaft of the umbrella; an inner ferrule integrally circumferentially formed on the runner tube, adapted for pivotally securing a plurality of ribs for fastening an umbrella cloth on the ribs, by a fastening wire wound on the inner ferrule and having wire ends twisted and knotted in a socket formed on the inner ferrule; and an outer ferrule snugly engaged with and disposed outside the inner ferrule for sheltering the wire ends for preventing the user or worker from being pricked by the wire ends, and having a pendent cover protruding from the outer ferrule for sheltering a spring catch resiliently protruded from the central shaft for preventing injury to the user's finger by the spring catch.

DETAILED DESCRIPTION

Figure 1:
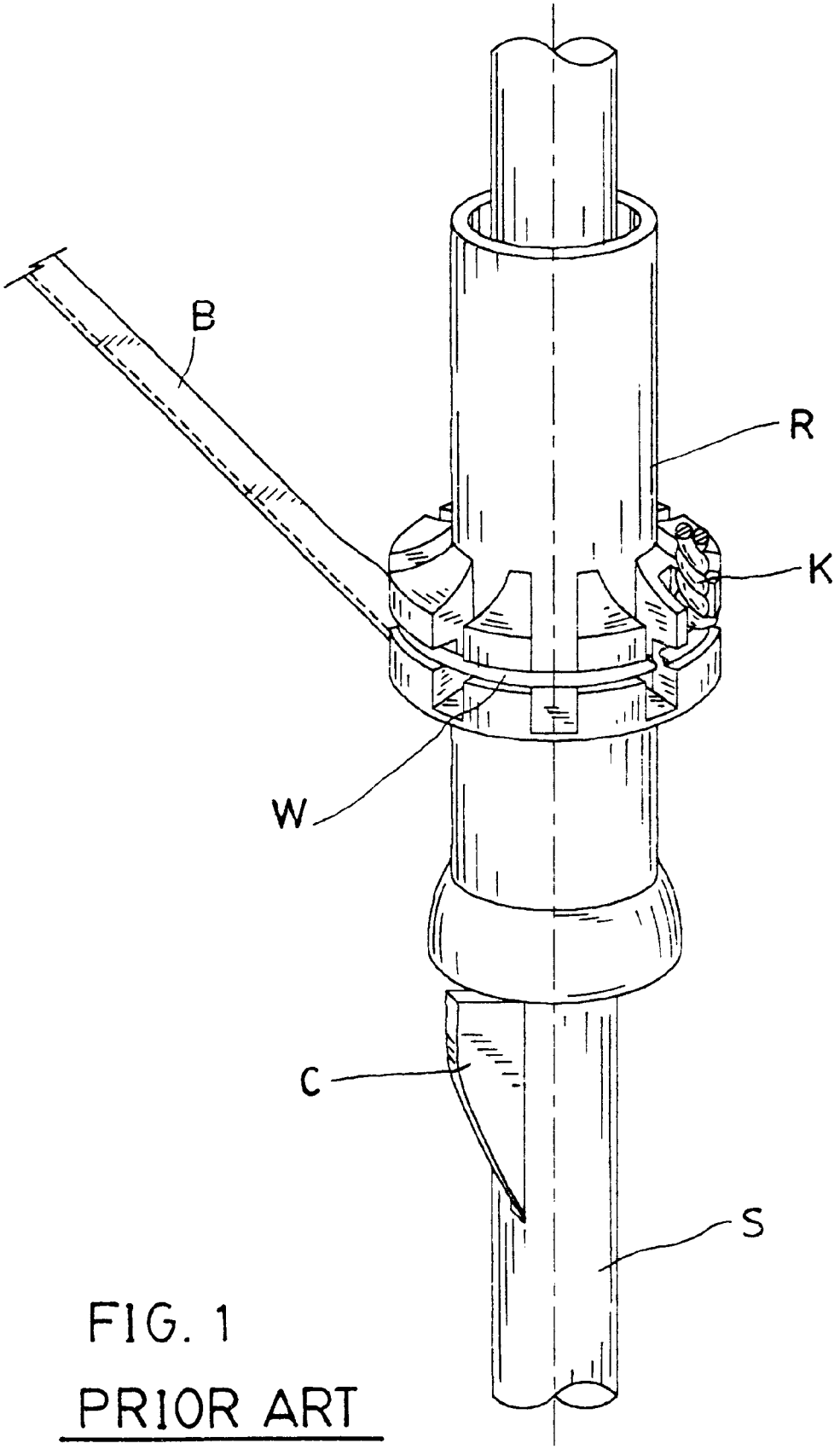
FIG. 1 PRIOR ART
FIG. 1 shows a conventional umbrella and spring catch held on a central shaft.
Figure 2:
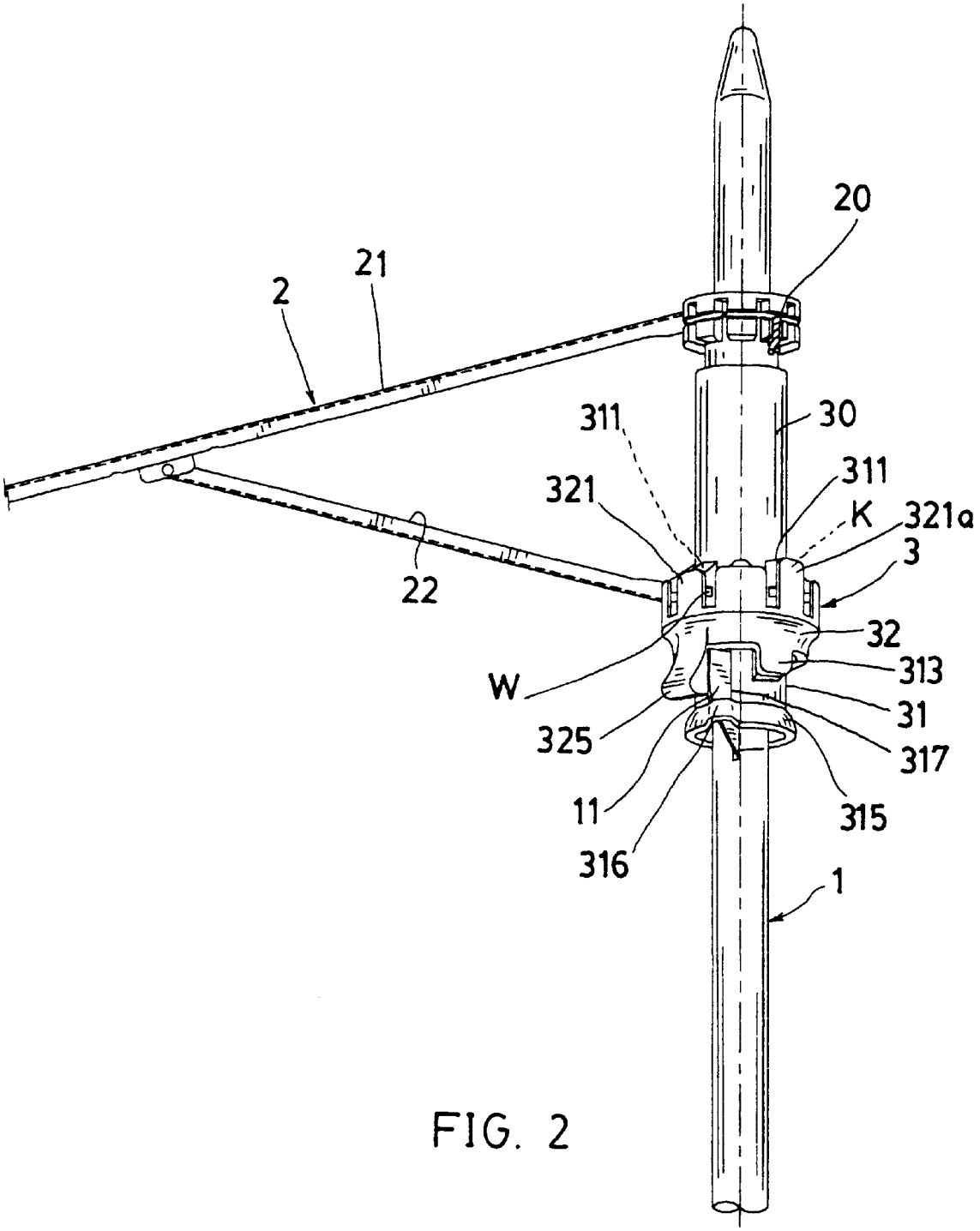
FIG. 2 is a perspective view of the present invention provided on an opened umbrella.
Figure 3:
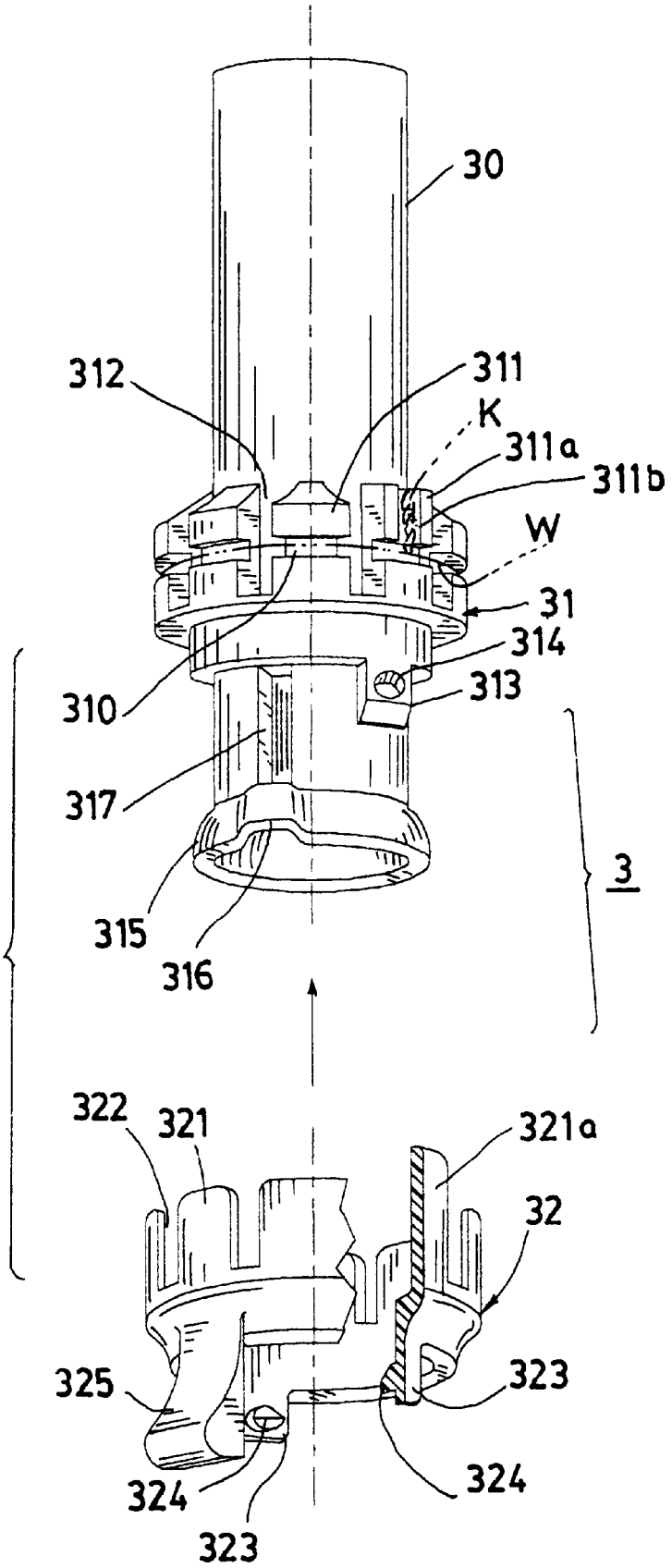
FIG. 3 is an exploded view of the present invention.
Figure 4:
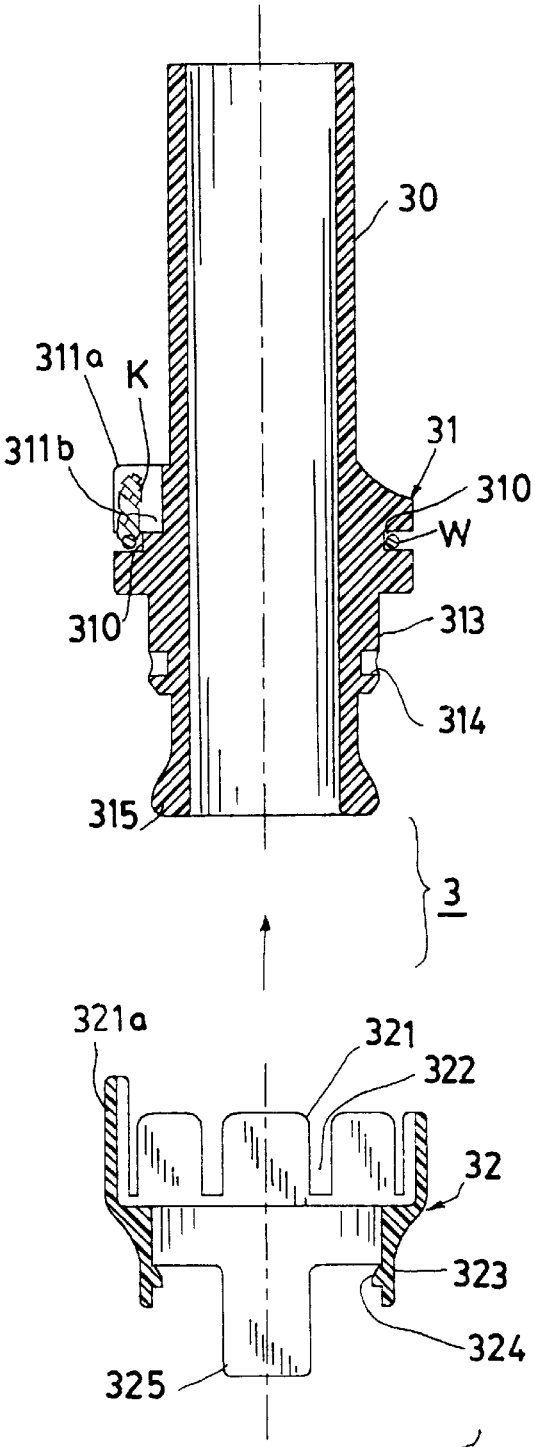
FIG. 4 is a sectional drawing showing the assembly of the two parts of the present invention.
Figure 5:
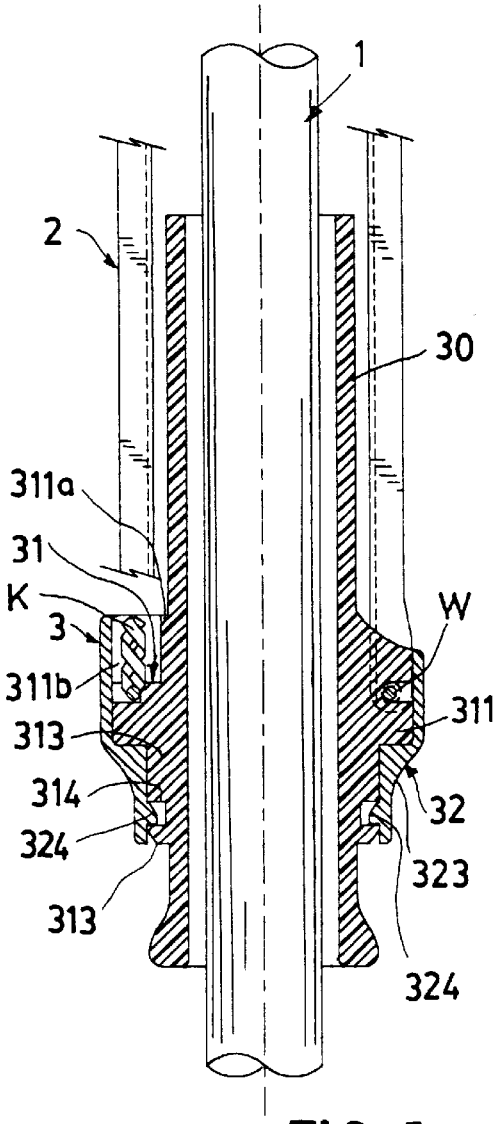
FIG. 5 is a sectional drawing of the present invention after assembly from FIG. 4.
Figure 6:
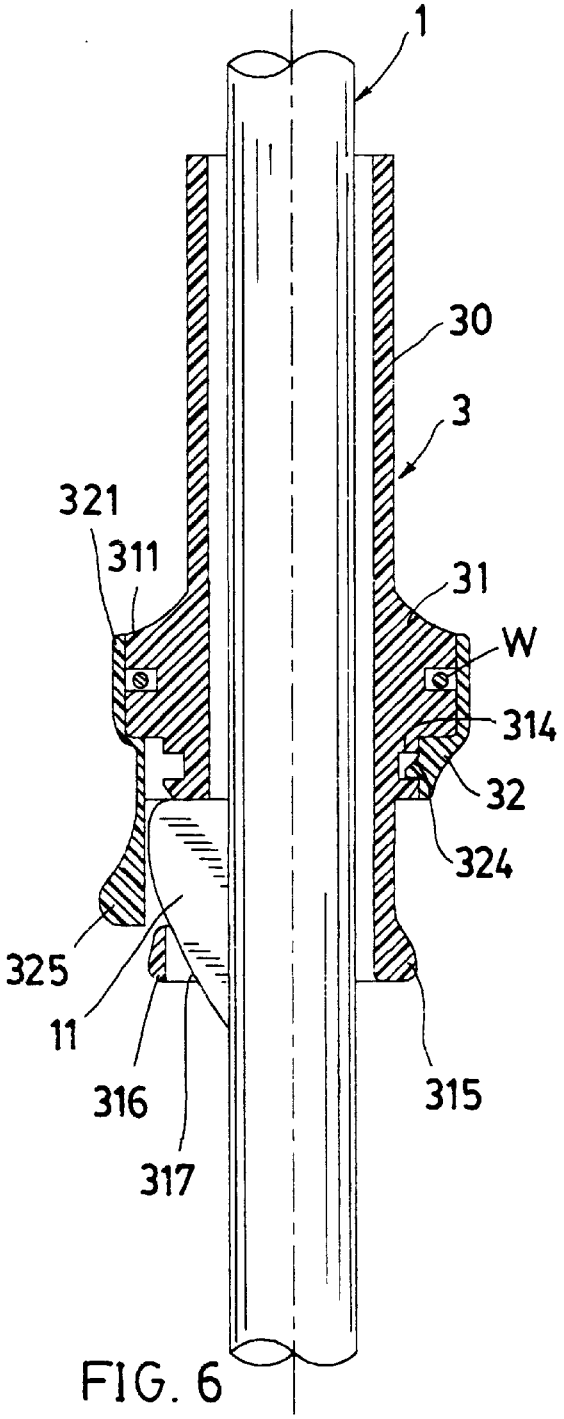
FIG. 6 is a sectional drawing showing a protection of the spring catch in accordance with the present invention.
Figure 7:
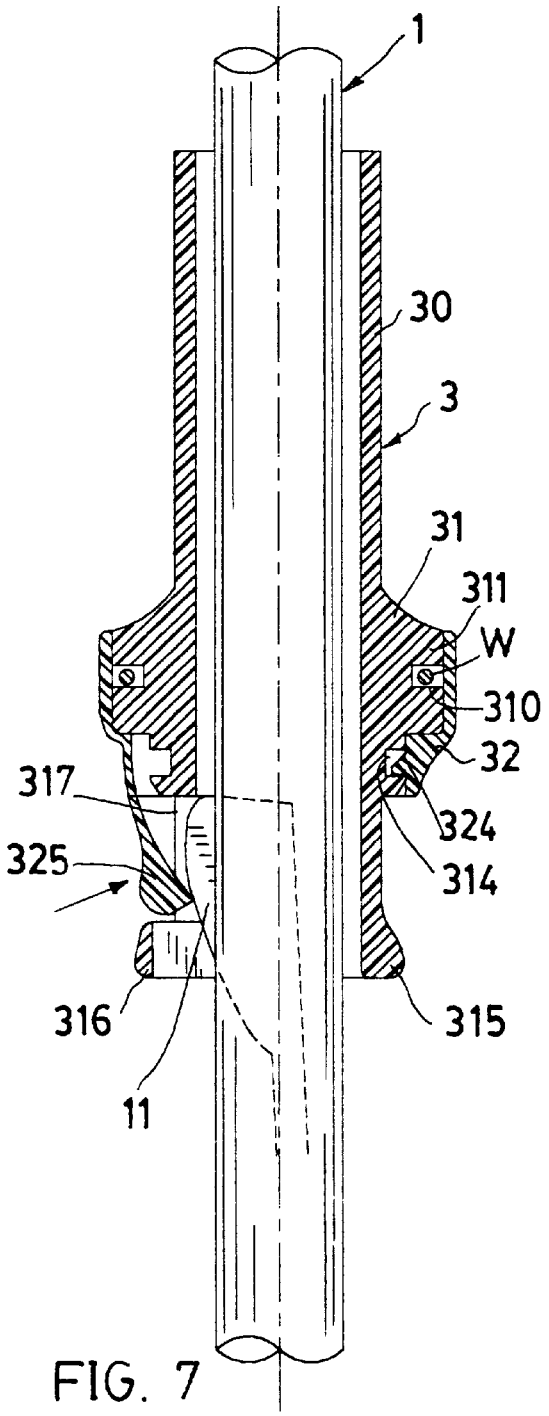
FIG. 7 shows a depression of the spring catch to prevent being pricked by the catch as effected by the present invention.

As shown in FIGS. 1–7, the present invention comprises: a safety runner 3 slidably held on a central shaft 1 for pivotally connecting a rib assembly 2 on the runner 3 which is locked on a spring catch 11 resiliently protruded from the shaft when opening the umbrella as shown in FIG. 2. The rib assembly 2 includes at least a top rib 21 pivotally secured to an upper notch 20 secured on an upper portion of the shaft 1, and a stretcher rib 22 pivotally connected between the top rib 21 and the runner 3 slidably held on the shaft 1. The rib assembly 2 may be modified to be other structures or linkages, not limited in this invention.

The safety runner 3 includes: a runner tube 30 slidably held on the central shaft 1; an inner ferrule 31 integrally formed on a middle and lower portion of the runner tube 30 for pivotally connecting each inner rib end of each stretcher rib 22 by a fastening wire W wound on the inner ferrule 31; and an outer ferrule 32 snugly engageable with and disposed about the inner ferrule 31 for sheltering the wire W and a pendent cover 325 formed on the outer ferrule 32 for sheltering the spring catch 11.

The inner ferrule 31 includes: a plurality of ridges 311 and furrows 312 alternatively corrugatedly formed on the inner ferrule 31, an annular groove 310 annularly recessed in the ridges 311 for engaging a fastening wire W in the annular groove 310 for pivotally securing a plurality of stretcher ribs 22 of the rib assembly 2 on the fastening wire W with each stretcher rib 22 pivoted in each furrow 312 defined between every two neighboring ridges 311, a knot-holding ridge 311*a* formed on the inner ferrule 31 as inserted between two ridges 311 having a socket 311*b* recessed in the knot-holding ridge 311*a* for embedding a wire knot K by twisting two free wire ends of the fastening wire W, as wound in the annular groove 310, into the socket 311*b* in the knot-holding ridge 311*a,* a pair of inner lugs 313 diametrically formed on and tapered downwardly from the inner ferrule 31 each inner lug 313 having a tooth hole 314 formed therein for engaging the outer ferrule 32, a bottom extension ring 315 circumferentially formed on a bottom end of the runner tube 30 having a catch protrusion 316 convex radially allowing a protrusion of a spring catch 11 resiliently protruded from the central shaft 1, and a catch slot 317 longitudinally cut out in a lower portion of the runner tube 30 for outwardly protruding the spring catch 11 for locking the runner 3 on the shaft 1 for retaining the rib assembly 2 when opening the umbrella.

The outer ferrule 32 includes: a plurality of outer ridges 321 and outer furrows 322 alternatively corrugatedly formed on the outer ferrule 32 and respectively corresponding to the ridges 311 and furrows 312 formed on the inner ferrule 31, a shelter ridge 321*a* formed on the outer ferrule 32 as inserted between two outer ridges 321 and corresponding to the knot-holding ridge 311*a* formed on the inner ferrule 31, a pair of outer lugs 323 diametrically formed on a lower portion of the outer ferrule 32 each outer lug 323 having a ratchet tooth 324 formed on an inside surface of the outer lug 323 to be engageable with each tooth hole 314 formed in each inner lug 313 when snugly coupling the outer ferrule 32 to the inner ferrule 31, and a pendent cover 325 protruding from the outer ferrule 32 for sheltering the spring catch 11 protruding outwardly through the catch slot 317 formed in the inner ferrule 31 when coupling the outer and inner ferrules 32, 31.

After winding the wires W in the groove 310 recessed in the inner ferrule 31 and twisting the free wire ends to be a wire knot K which is embedded into the socket 311*b* of the knot-holding ridge 311*a* among the ridges 311 of the inner ferrule 31, the outer ferrule 32 is slid to be engaged with the inner ferrule 31 (FIGS. 3–5) to allow the outer ridge 321 of the outer ferrule to shelter the ridges 311 of the inner ferrule 31 and to allow the shelter ridge 321*a* of the outer ferrule to shelter the knot-holding ridge 311*a* of the inner ferrule to shield and conceal the wire knot K inside the outer ferrule 32 for preventing pricking to a user's or worker's fingers. Each ratchet tooth 324 of the outer ferrule 32 is engaged with the tooth hole 314 in the inner ferrule 31 for firmly coupling the outer ferrule 32 on the inner ferrule 31. The pendent cover 325 on the outer ferrule 32 will shelter the spring catch 11 to prevent the fingers from being injured by the acute spring catch 11.

So, this invention provides a safety runner really safely protecting a user or a worker of the umbrella both for prevention of pricking injury by the wire ends fastened on the runner ferrule and for prevention of injury as caused by the spring catch resiliently retained on the shaft. The coupling of the outer and inner ferrules 32, 31 is so easy, thereby also decreasing the industrial accident of the worker as pricked by the wire ends during the factory production. This invention is safer than the prior art. Meanwhile, the outer and inner ferrules are coupled smoothly and neatly for eahancing their esthetic decorative effect.

Figure 8:
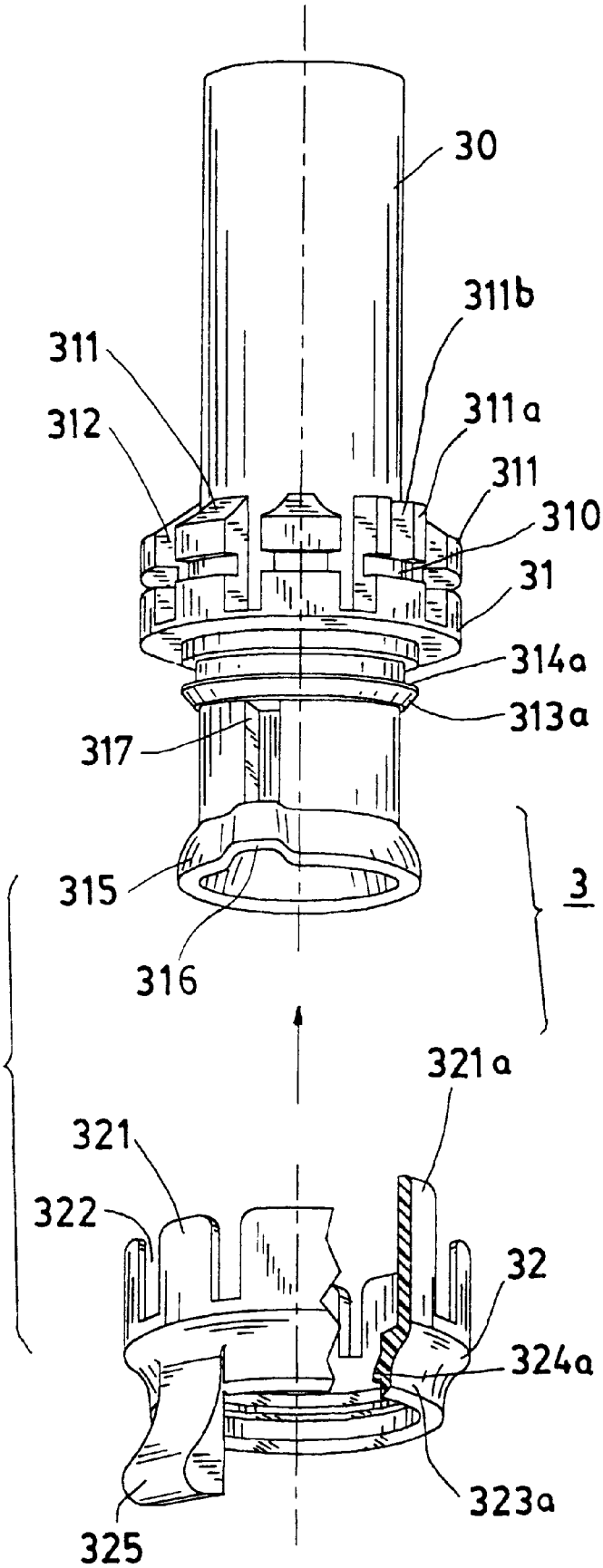
FIG. 8 is an exploded view of another preferred embodiment of the present invention.
Figure 9:
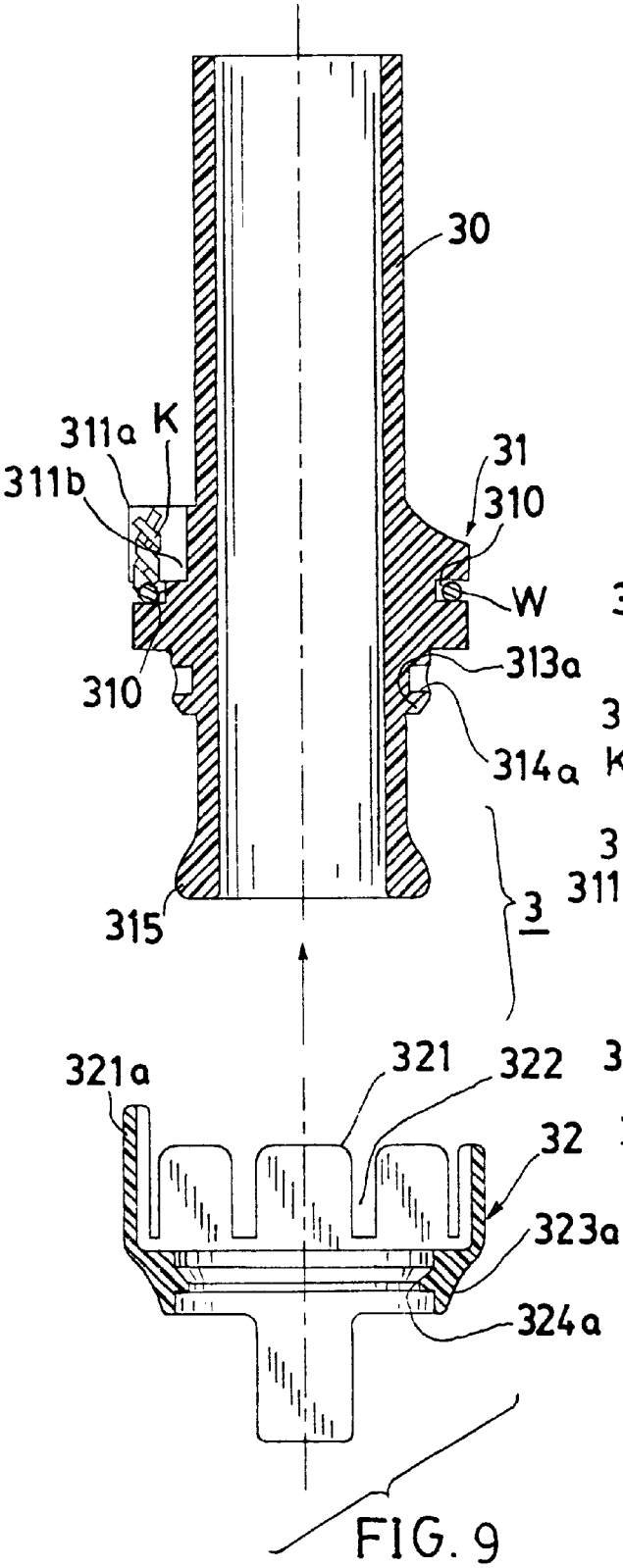
FIG. 9 is a sectional drawing of the present invention before being assembled.
Figure 10:
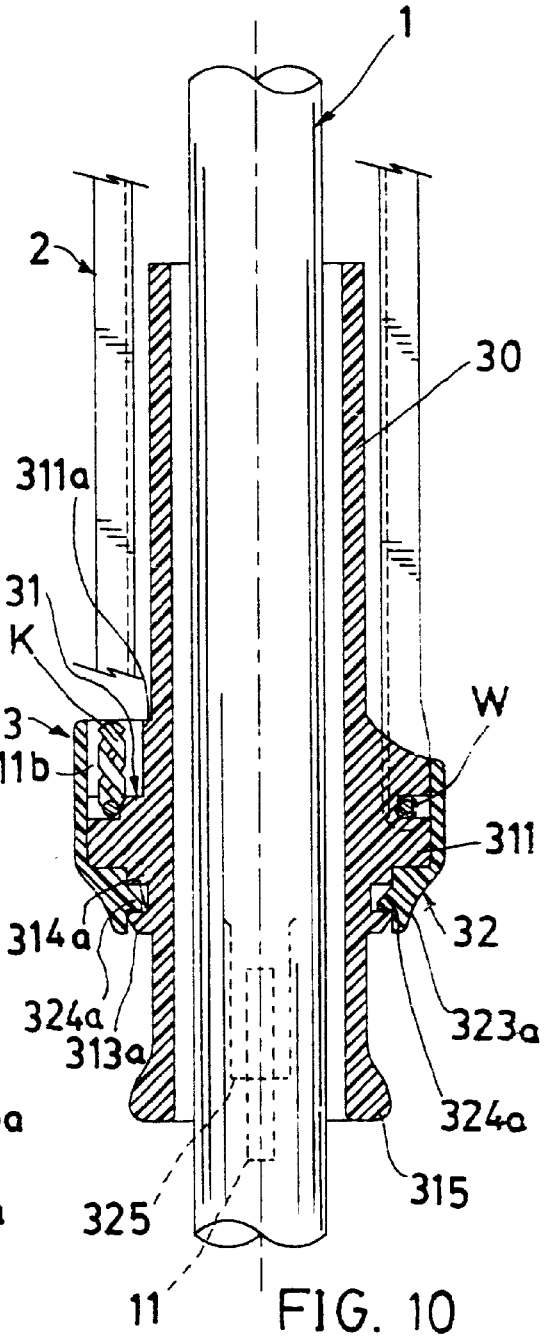
FIG. 10 is a sectional drawing of the present invention as assembled from FIG. 9.

Another preferred embodiment of the present invention is modified from the aforementioned example to be shown in FIGS. 8, 9 and 10.

The inner ferrule 31 includes: a tapered bottom flange 313*a* circumferentially formed on a bottom end of the inner ferrule 31, and a tooth groove 314*a* annularly recessed in a lower portion of the inner ferrule 31 adjacent to the bottom flange 313*a;* and the outer ferrule 32 having an annular ratchet tooth 324*a* annularly formed on an inside surface of a lower sleeve portion 323*a* formed on a lower periphery of the outer ferrule 32, and the ratchet tooth 324*a* of the outer ferrule 32 engaged with the tooth groove 314 formed in the inner ferrule 31 for coupling the outer ferrule 32 on the inner ferrule 31 for shielding the wire ends as fastened in the inner ferrule 31. The pendent cover 325 formed on the outer ferrule 32 will shelter the spring catch 11 protruded from the shaft 1.

The present invention may be further modified without departing from the spirit and scope of the present invention.

I claim:

1. A safety umbrella runner comprising:

a runner tube slidably held on a central shaft of an umbrella;

an inner ferrule integrally circumferentially formed on the runner tube, adapted for pivotally securing a plurality of ribs for fastening an umbrella cloth on the ribs, by a fastening wire wound on the inner ferrule and having two wire ends of the wire twisted and knotted to form a wire knot embedded in a socket formed in the inner ferrule;

an outer ferrule snugly engaged with and disposed outside the inner ferrule for sheltering the wire knot and wire ends for preventing injury to a user or worker as being pricked by the wire ends, and a pendent cover protruding from the outer ferrule for sheltering a spring catch resiliently protruded from the central shaft for preventing injury to a user's finger by the spring catch;

said inner ferrule including: a plurality of ridges and furrows alternatively corrugatedly formed on the inner ferrule, an annular groove annularly recessed in the ridges for engaging said fastening wire in the annular groove for pivotally securing said plurality of ribs on the fastening wire with each said rib pivoted in each said furrow defined between every two neighboring ridges, a knot-holding ridge formed on the inner ferrule as inserted between said two ridges having said socket recessed in the knot-holding ridge for embedding said wire knot by twisting said two wire ends of the fastening wire, as wound in the annular groove, into the socket in the knot-holding ridge, a pair of inner lugs diametrically formed on and tapered downwardly from the inner ferrule each said inner lug having a tooth hole formed therein for engaging the outer ferrule, a bottom extension ring circumferentially formed on a bottom end of the runner tube having a catch protrusion convex radially from the bottom extension ring for allowing a protrusion of the spring catch resiliently protruded from the central shaft, and a catch slot longitudinally cut out in a lower portion of the runner tube for outwardly protruding the spring catch for locking the runner on the shaft for retaining the ribs when opening the umbrella; and said outer ferrule including: a plurality of outer ridges and outer furrows alternatively corrugatedly formed on the outer ferrule and respectively corresponding to the ridges and furrows formed on the inner ferrule, a shelter ridge formed on the outer ferrule as inserted between two outer ridges and corresponding to the knot-holding ridge formed on the inner ferrule, a pair of outer lugs diametrically formed on a lower portion of the outer ferrule each said outer lug having a ratchet tooth formed on an inside surface the outer lug to be engaged with each said tooth hole formed in each said inner lug when snugly coupling the outer ferrule to the inner ferrule, and said pendent cover protruding from the outer ferrule for sheltering the spring catch protruding outwardly through the catch slot formed in the inner ferrule when coupling the outer and inner ferrules.

* * * * *